US009857757B2

(12) United States Patent
Inada et al.

(10) Patent No.: US 9,857,757 B2
(45) Date of Patent: Jan. 2, 2018

(54) CONTAINER AND IMAGE FORMING APPARATUS

(71) Applicant: CANON KABUSHIKI KAISHA, Tokyo (JP)

(72) Inventors: Seiji Inada, Numazu (JP); Chikara Imaizumi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 26 days.

(21) Appl. No.: 15/202,017

(22) Filed: Jul. 5, 2016

(65) Prior Publication Data

US 2017/0010563 A1 Jan. 12, 2017

(30) Foreign Application Priority Data

Jul. 8, 2015 (JP) ..... 2015-137311

(51) Int. Cl.
*G03G 21/10* (2006.01)
*G03G 21/12* (2006.01)
*G03G 15/08* (2006.01)

(52) U.S. Cl.
CPC ..... *G03G 21/105* (2013.01); *G03G 21/12* (2013.01); *G03G 15/0865* (2013.01)

(58) Field of Classification Search
CPC ..... G03G 21/10; G03G 21/105; G03G 21/12
See application file for complete search history.

(56) References Cited

U.S. PATENT DOCUMENTS 4,711,561 A * 12/1987 Tsuruoka ..... G03G 21/12 399/35
5,021,825 A * 6/1991 Niki ..... G03G 21/12 399/111
2006/0039710 A1* 2/2006 Tawada ..... G03G 21/105 399/35
2011/0243585 A1* 10/2011 Mizutani ..... G03G 15/0856 399/35
2012/0001382 A1* 1/2012 Yano ..... B65H 5/062 271/225
2013/0223859 A1* 8/2013 Wakamatsu ..... G03G 21/105 399/34
2014/0147165 A1* 5/2014 Sakuma ..... G03G 21/12 399/102
2015/0261172 A1* 9/2015 Karasawa ..... G03G 21/12 399/35

FOREIGN PATENT DOCUMENTS

JP 2009-251088 A 10/2009

* cited by examiner

*Primary Examiner* — Carla Therrien
(74) *Attorney, Agent, or Firm* — Canon USA, Inc. I.P. Division

(57) ABSTRACT

A container includes a collecting portion in which toner discharged from an apparatus body is accumulated, a conveying member that conveys the toner in the collecting portion in a direction away from an intake portion provided in the collecting portion, and a movable member movable in accordance with an amount of toner in the collecting portion and that causes, when the movable member reaches a first position, a detecting portion to detect an amount of toner in the collecting portion. The movable member includes a guiding portion that guides the toner in a direction away from the first position while the toner is conveyed by the conveying member.

20 Claims, 8 Drawing Sheets

CONTAINER AND IMAGE FORMING APPARATUS

BACKGROUND

Field

Aspects of the present invention generally relate to a container included in an image forming apparatus and in which post-transfer residual toner is collected.

Description of the Related Art

In related-art electrophotographic image forming apparatuses such as printers, copiers, and facsimiles, some of the toner composing toner images formed on image bearing members, such as photoconductor drums and transfer belts, may be left on the image bearing members without being transferred to recording materials, such as paper. Such post-transfer residual toner left on the photoconductor drums and the transfer belts is removed therefrom by cleaning mechanisms and is conveyed by a toner conveying mechanism to a toner collecting case (a container) provided in the body of the image forming apparatus.

Typically, for example, such a toner collecting case is detachably attached to the body of the image forming apparatus. When the toner collecting case fills up with collected toner, the toner collecting case is detached from the image forming apparatus body and is replaced with a new toner collecting case. Currently, detecting that the toner collecting case has filled up occurs using, for example, a transparent or translucent detecting portion and an optical sensor. The detecting portion is provided at a part of the toner collecting case. The optical sensor includes a light-emitting portion and a light-receiving portion between which the detecting portion is positioned.

In such a case, when some toner is collected in the detecting portion and light emitted from the light-emitting portion is blocked by the collected toner before reaching the light-receiving portion, the toner collecting case is regarded as being full. In another case, the toner collecting case is held by an elastic member so that the toner collecting case is lowered in accordance with the weight of collected toner, and the lowering of the toner collecting case is detected by a sensor.

In the above two cases, only a single state of the toner collecting case is detectable. Therefore, to give the user time to prepare a new toner collecting case, an alert is issued when a nearly full state of the toner collecting case is detected. Thereafter, an estimation of when the toner collecting case will become full is made from the number of printed pages, and the image forming apparatus is stopped based on the estimation. However, the degree of difference between the estimation and the actual value varies with the degree of difference in the rate of printing area. Hence, the alert notifying the user of the nearly full state of the toner collecting case needs to be provided early enough to give the user enough time to prepare a new toner collecting case. Consequently, the image forming apparatus is occasionally stopped in spite of the toner collecting case still having enough room, which leads to unnecessary replacement of the toner collecting case.

To avoid the above issue, an apparatus is disclosed by Japanese Patent Laid-Open No. 2009-251088 in which the amount of toner is detected at different stages using a plurality of sensors.

According to Japanese Patent Laid-Open No. 2009-251088, however, providing a plurality of sensors can increase the manufacturing cost of the image forming apparatus. Furthermore, considering the configuration of the image forming apparatus, a satisfactorily long space is needed for the vertical movement of the toner collecting case, which can lead to an increase in the size of the image forming apparatus body.

SUMMARY OF THE INVENTION

Aspects of the present invention generally provide a container having a simple mechanism for accurately detecting the state of the container in which toner is collected.

According to an aspect of the present invention, there is provided a container in which toner discharged from an apparatus body of an image forming apparatus is collected. The container includes an intake portion from which the toner discharged from the apparatus body enters the container, a collecting portion in which the toner entering via the intake portion accumulates, a conveying member configured to convey the toner in the collecting portion in a direction away from the intake portion, and a movable member movable in accordance with an amount of toner in the collecting portion and configured to cause, when the movable member is at a first position, a detecting portion to detect an amount of toner in the collecting portion, the detecting portion being provided on the apparatus body. The movable member includes a guiding portion configured to guide the toner in a direction away from the first position while the toner is conveyed by the conveying member.

Further features of aspects of the present invention will become apparent from the following description of exemplary embodiments with reference to the attached drawings.

DESCRIPTION OF THE EMBODIMENTS

Embodiments of the present invention will now be described in detail with reference to the attached drawings.

Note that the dimensions, materials, shapes, relative positions, and other factors of elements described herein can be flexibly changed in accordance with the configuration and various other conditions of an apparatus to which aspects of the present invention are applied. That is, the scope of aspects of the present invention is not limited to the following embodiments.

First Embodiment

Figure 11:
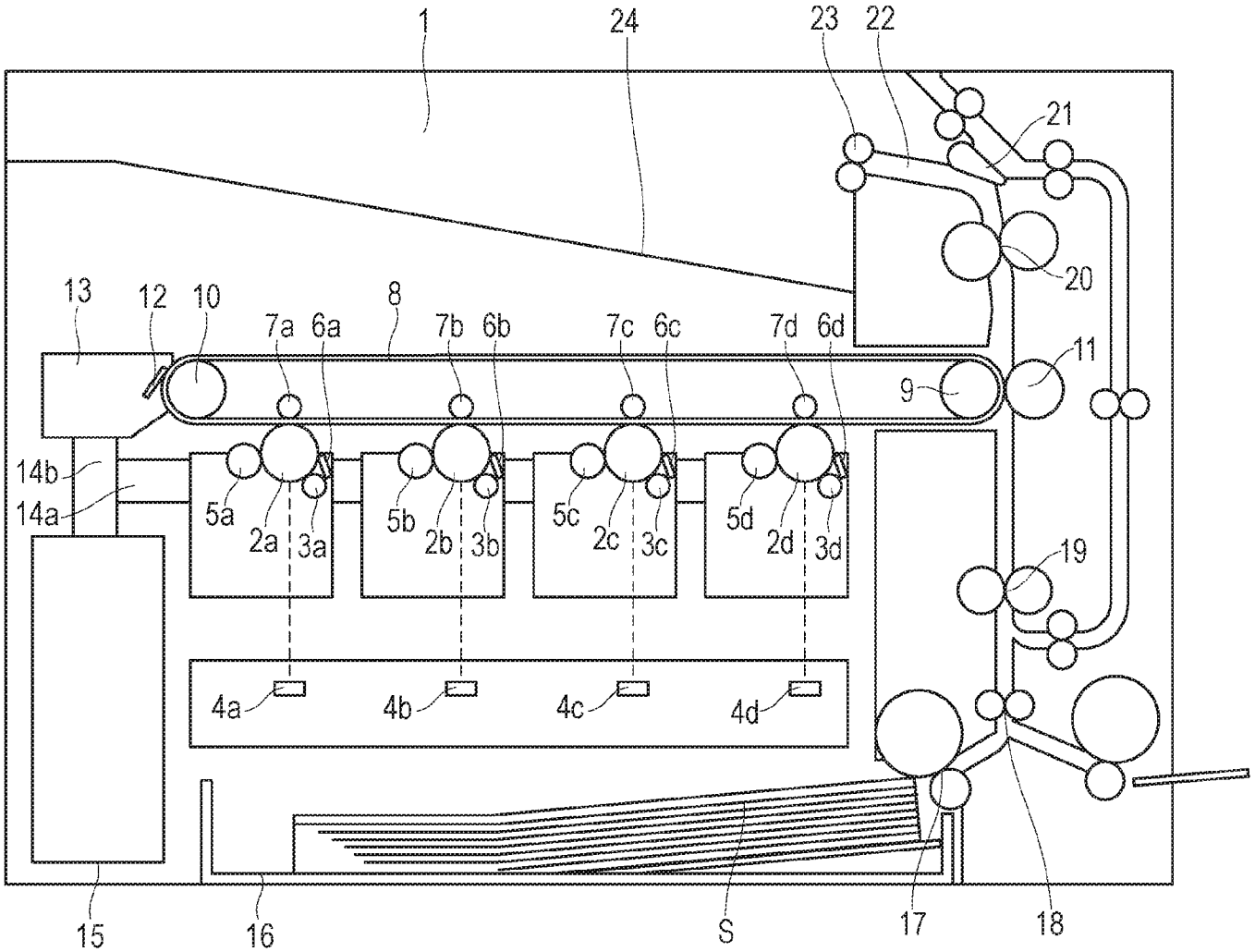
FIG. 11 is a schematic sectional view of an image forming apparatus that includes the toner collecting case according to any of the first to third embodiments of the present invention.

FIG. 11 is a schematic sectional view of an exemplary electrophotographic color image forming apparatus that includes a toner collecting mechanism according to a first embodiment of the present invention. The image forming apparatus includes an apparatus body 1, in which the following elements are provided. Four drum-type image bearing members, i.e., photoconductor drums 2 (2*a*, 2*b*, 2*c*, and 2*d*), are provided side by side in a substantially horizontal direction. The photoconductor drums 2 are each driven by a driving device (not illustrated) and are thus rotated clockwise in FIG. 11. Charging devices 3 (3*a*, 3*b*, 3*c*, and 3*d*) uniformly charge the surfaces of the respective photoconductor drums 2. Scanner units 4 (4*a*, 4*b*, 4*c*, and 4*d*) apply laser beams to the respective photoconductor drums 2 based on image information, thereby forming electrostatic latent images on the respective photoconductor drums 2. Developing devices 5 (5*a*, 5*b*, 5*c*, and 5*d*) develop the electrostatic latent images on the photoconductor drums 2 into toner images by causing toner, which contains developer, to be attracted to the electrostatic latent images. Drum cleaning devices 6 (6*a*, 6*b*, 6*c*, and 6*d*) remove post-transfer residual toner from the surfaces of the respective photoconductor drums 2, from which the toner images have been transferred, to an intermediate transfer belt 8.

The image forming apparatus according to the first embodiment includes four image forming units, each including one photoconductor drum 2, one charging device 3, one developing device 5, and one drum cleaning device 6 that are assembled into a cartridge that is detachably attached to the apparatus body 1. The four image forming units electrophotographically form images in different colors (yellow, cyan, magenta, and black), respectively.

Primary transfer rollers 7 (7*a*, 7*b*, 7*c*, and 7*d*) serving as transfer devices are pressed against the respective photoconductor drums 2 with the intermediate transfer belt 8 interposed therebetween. The primary transfer rollers 7 transfer the toner images from the respective photoconductor drums 2 to the intermediate transfer belt 8. The intermediate transfer belt 8 is stretched between a driving roller 9 and a tension roller 10 and is rotated counterclockwise by the driving roller 9. A secondary transfer roller 11 is provided across the intermediate transfer belt 8 from the driving roller 9 and transfers the set of toner images from the intermediate transfer belt 8 to a sheet S (a recording material). A cleaning blade 12 and an in-belt-unit toner conveying mechanism 13 that are included in an intermediate-transfer-belt-cleaning device are provided across the intermediate transfer belt 8 from the tension roller 10. The intermediate-transfer-belt-cleaning device removes and collects post-transfer residual toner from the surface of the intermediate transfer belt 8. The collected post-transfer residual toner is conveyed into a toner collecting case 15 by toner conveying mechanisms 14 (a drum-side toner conveying mechanism 14*a* and a belt-side toner conveying mechanism 14*b*).

A sheet feeding cassette 16 serving as a feeding device is provided at the bottom of the image forming apparatus. A pair of registration rollers 19 serving as a conveying device corrects the orientation of the sheet S that may skew. The set of toner images formed by the image forming units and transferred from the intermediate transfer belt 8 to the sheet S is fixed by a fixing device 20. A flap 21 serves as a conveying-path-switching device. In simplex printing, the flap 21 guides the sheet S into a sheet discharging path 22. A pair of discharging rollers 23 discharges the sheet S to a discharged-sheet tray 24 serving as a sheet receiving portion.

Sheets S stacked in the sheet feeding cassette 16 are picked up one by one by a sheet feeding roller 17. Each sheet S picked up is fed to a pair of sheet drawing rollers 18, to the pair of registration rollers 19, and to a nip (a secondary transfer part) between the intermediate transfer belt 8 and the secondary transfer roller 11. The set of toner images transferred from the image forming units to the intermediate transfer belt 8 forms a color image, which is transferred to the sheet S at the nip between the intermediate transfer belt 8 and the secondary transfer roller 11. Then, the sheet S is conveyed to the fixing device 20. The fixing device 20 fixes the image on the sheet S by applying heat and pressure thereto. The sheet S now having the fixed image, composed of the toner images in different colors, is guided into the sheet discharging path 22 by the flap 21 and is discharged onto the discharged-sheet tray 24 by the pair of discharging rollers 23.

Some of the toner composing the set of toner images may be left on the intermediate transfer belt 8 without being transferred to the sheet S at the secondary transfer part. Such post-transfer residual toner is scraped off the intermediate transfer belt 8 by the cleaning blade 12 and conveyed toward the belt-side toner conveying mechanism 14*b* by the in-belt-unit toner conveying mechanism 13. Meanwhile, some of the toner left on the photoconductor drums 2 without being transferred to the intermediate transfer belt 8 in the process of forming the toner images is scraped off the photoconductor drums 2 by the drum cleaning devices 6. This toner is conveyed toward the left side in FIG. 1 by the drum-side toner conveying mechanism 14*a* and is mixed with the toner conveyed to the belt-side toner conveying mechanism 14*b*. The toner resulting from the mixture is then conveyed from the belt-side toner conveying mechanism 14*b* into the toner collecting case 15 and accumulated there.

Featured Mechanism of First Embodiment

Figure 1:
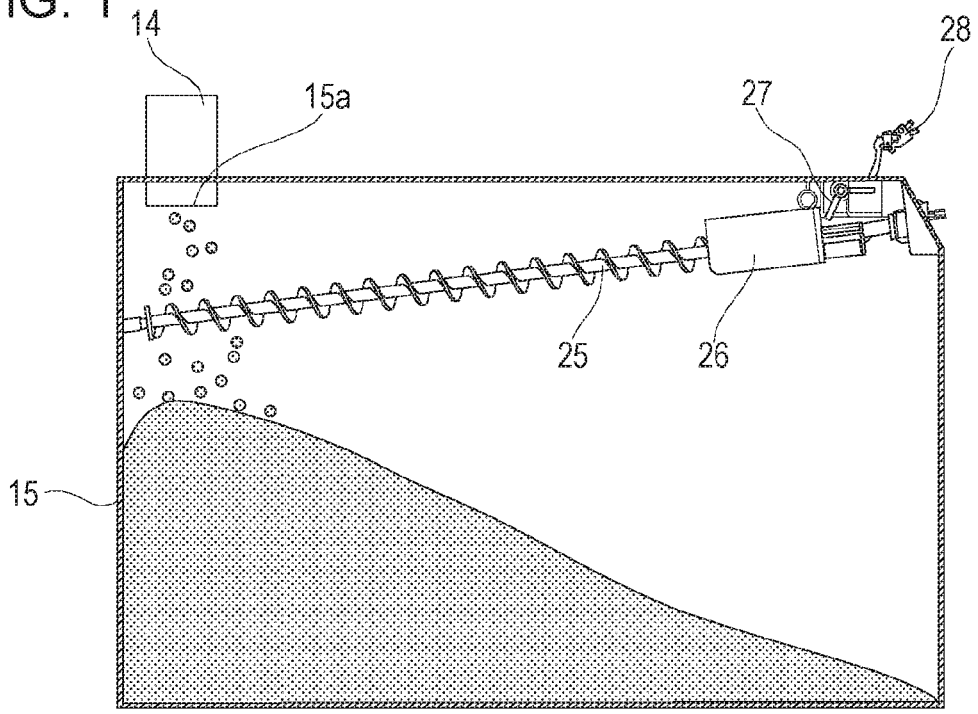
FIG. 1 illustrates a configuration of a toner collecting case according to a first embodiment of the present invention.
Figure 2:
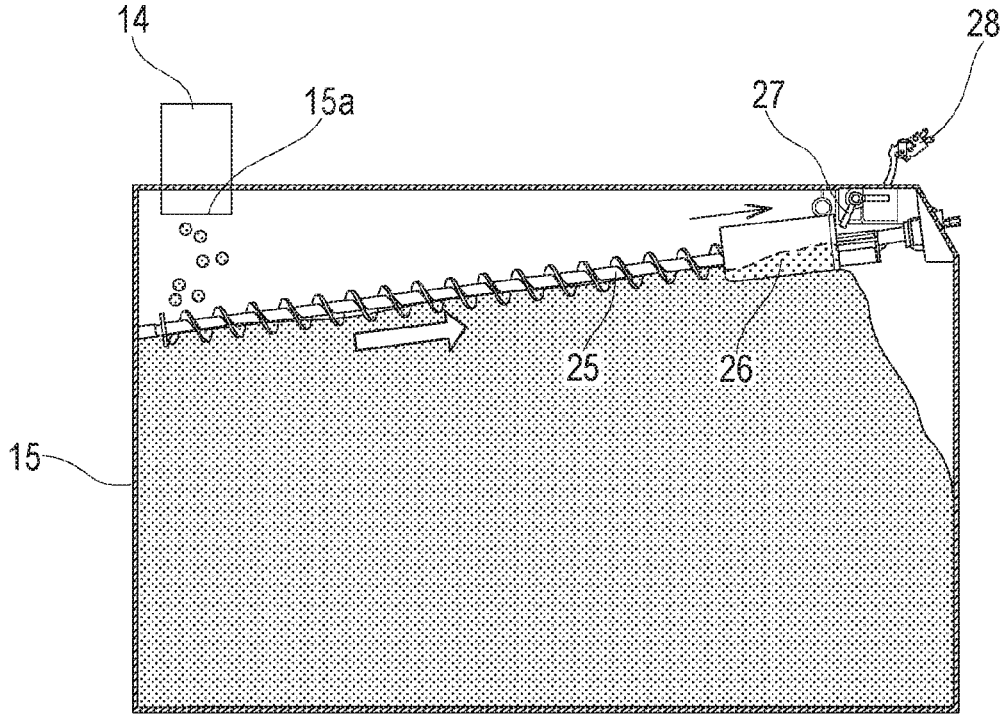
FIG. 2 illustrates a state where a movable member starts to move in the first embodiment of the present invention.
Figure 3:
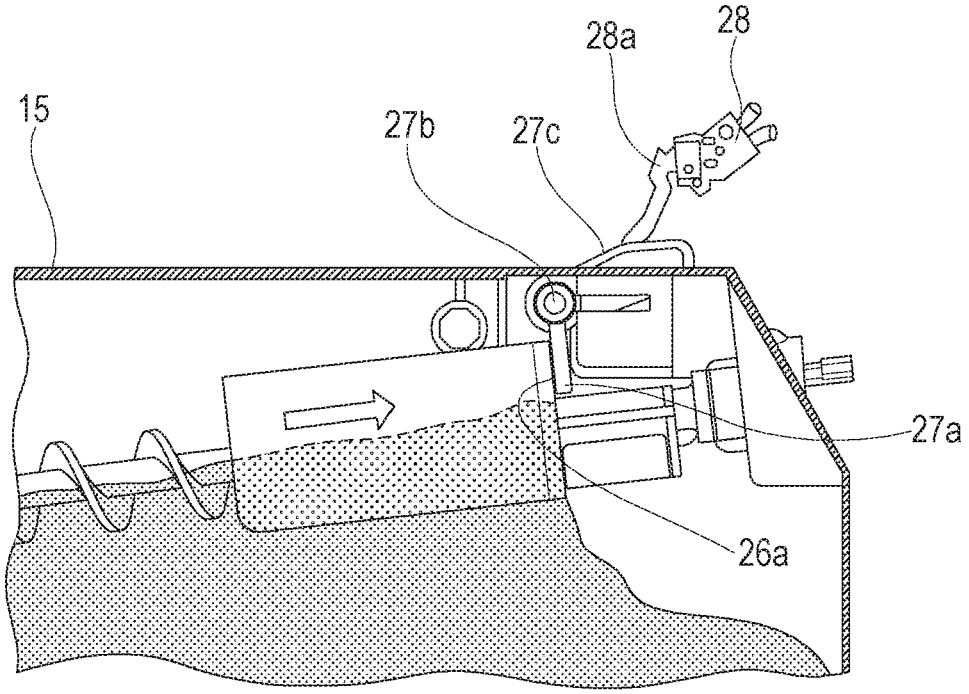
FIG. 3 illustrates the toner collecting case that has become nearly full in the first embodiment of the present invention.

Referring now to FIGS. 1 to 6, characteristic features of the first embodiment of the present invention, i.e., a mechanism of detecting a full state of the toner collecting case 15, will be described. FIGS. 1 to 3 are schematic sectional views of the toner collecting case 15 according to the first embodiment. FIG. 1 illustrates an overall configuration of the toner collecting case 15. FIG. 2 illustrates how a movable member moves. FIG. 3 illustrates a device that detects the position of the movable member.

Referring to FIG. 1, the configuration of the toner collecting case 15 according to the first embodiment will first be described. The toner collecting case 15 (a container) includes a collecting area (a collecting portion) in which toner discharged from the apparatus body 1 is accumulated. The toner collecting case 15 also includes a collecting port 15*a* (an intake portion) from which toner conveyed by the toner conveying mechanisms 14 is taken into the toner collecting case 15. The toner collecting case 15 is detachably attached to the apparatus body 1. The collecting port 15*a* is positioned in the collecting area of the toner collecting case 15 and on the rear side of the apparatus body 1. The toner collecting case 15 includes a conveying screw 25 (a conveying member) extending from a side of the collecting port 15*a* toward the other side (i.e., the inner side of the collecting area). The conveying screw 25 conveys toner in the direction from the side of the intake portion toward the inner side. The toner collecting case 15 further includes a movable member 26 that is movable in the direction of toner conveyance. That is, the position of the movable member 26 changes with the amount of toner accumulated in the collecting area. The movable member 26 is moved by the toner conveyed by the conveying screw 25. The toner collecting case 15 further includes a detecting lever 27 (a switch) whose position changes when pushed by the movable member 26.

Referring to FIGS. 1 to 3, a method of detecting a full state of the toner collecting case 15 will now be described. Toner taken from the collecting port 15*a* freely falls and is accumulated in the toner collecting case 15 (as illustrated in FIG. 1). When the accumulated amount of the toner in the toner collecting case 15 reaches the conveying screw 25, some toner at the top is conveyed by the conveying screw 25 in a direction away from the collecting port 15*a*. As more toner accumulates, as illustrated in FIG. 2, the toner conveyed by the conveying screw 25 starts to move the movable member 26. When the movable member 26 is moved, a pushing part 26*a* of the movable member 26 contacts a pushed part 27*a* of the detecting lever 27 and causes the detecting lever 27 to rotate about a shaft 27*b*.

When the movable member 26 is further moved and reaches a first position (an activating position) to rotate the detecting lever 27 by a predetermined angle, an acting part 27*c* of the detecting lever 27 pushes a sensor lever 28*a* of a sensor 28 (a detecting portion) provided on the apparatus body 1. Thus, the state of a signal generated by the sensor 28 changes (the detecting portion is activated and starts detection, see FIG. 3). The change in the signal is regarded as indicating a nearly full state, and an alert that prompts the user to be prepared to replace the toner collecting case 15 with a new one is issued. Then, the amount of toner consumed thereafter is estimated from printing conditions. When it is determined that a predetermined amount of toner has been consumed, the operation of the apparatus is stopped.

Known mechanisms are applicable to the estimation of the amount of toner consumption and the estimation of the amount of collected toner based on the estimation of toner consumption that are made using the sensor 28 according to the first embodiment. For example, when the sensor 28 detects the nearly full state of the toner collecting case 15, the sensor 28 provides a "nearly full" signal to a controller controlling the apparatus body 1, and the controller displays, on a display (not illustrated) of the apparatus body 1, an alert prompting the user to be prepared to replace the toner collecting case 15 with a new one.

Simultaneously with the determination that the toner collecting case 15 has become nearly full, an engine controller starts to count pixels. When the number of counted pixels reaches a predetermined value, the engine of the controller that controls the apparatus body 1 is stopped. The number of pixels counted in a period from the detection of the nearly full state until the stoppage of the engine is set to a value that provides the user with sufficient time to prepare a new toner collecting case 15. For example, under typical conditions, approximately a month is provided to prepare for use defined for products of the category of interest (e.g., at a rate of printing area of 5%, at a monochrome-to-full-color ratio of 4:6, and in a volume of printing per month of 3,000 pages).

Figure 4:
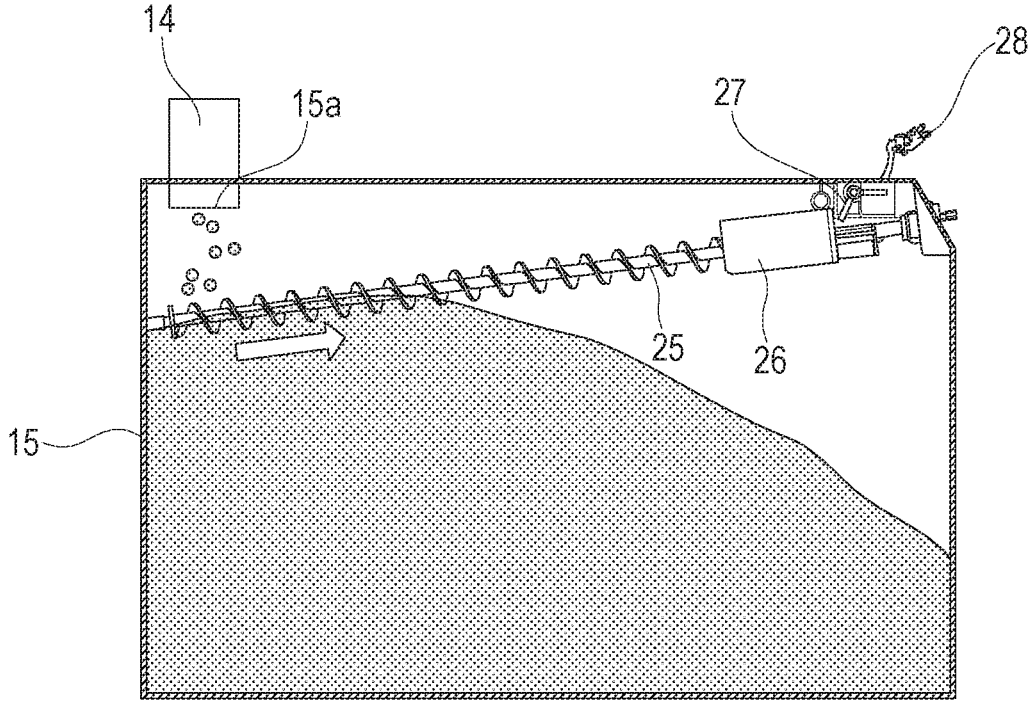
FIG. 4 illustrates the toner collecting case that is yet to become nearly full in the first embodiment of the present invention.
Figure 5:
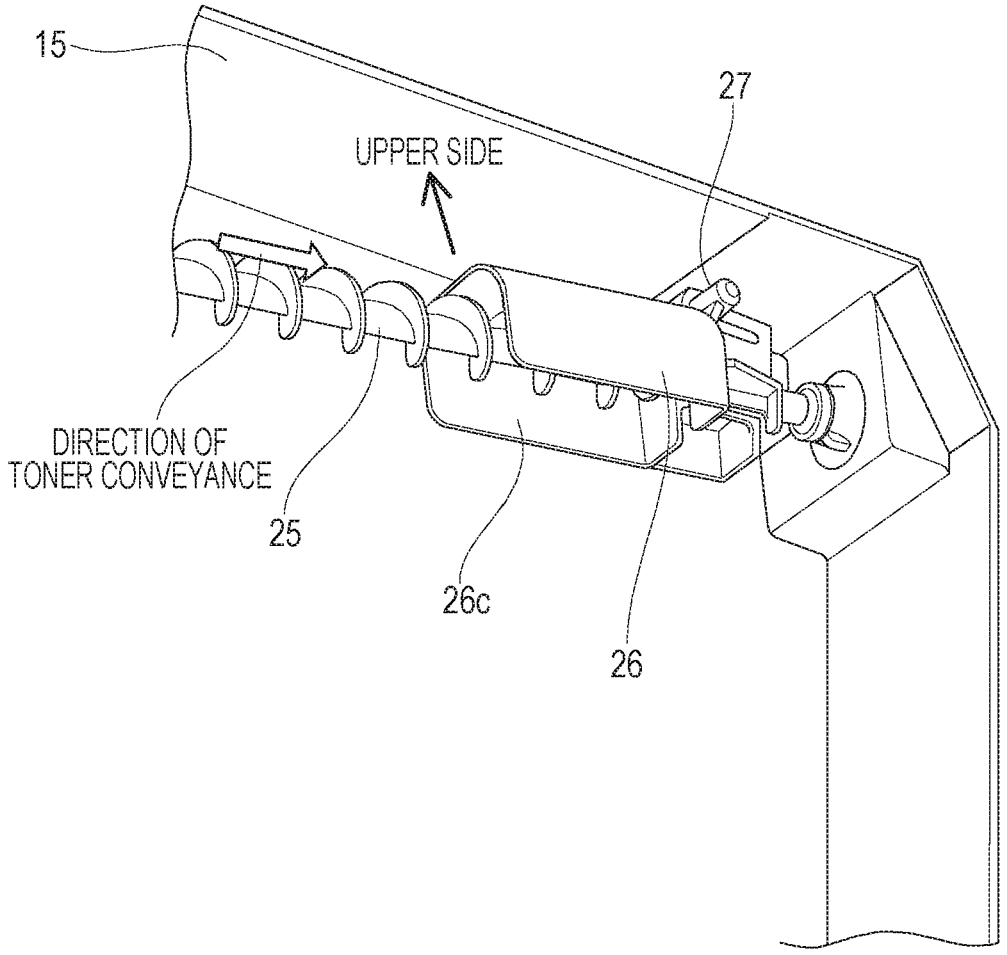
FIG. 5 is an internal perspective view of the toner collecting case according to the first embodiment of the present invention.
Figure 6:
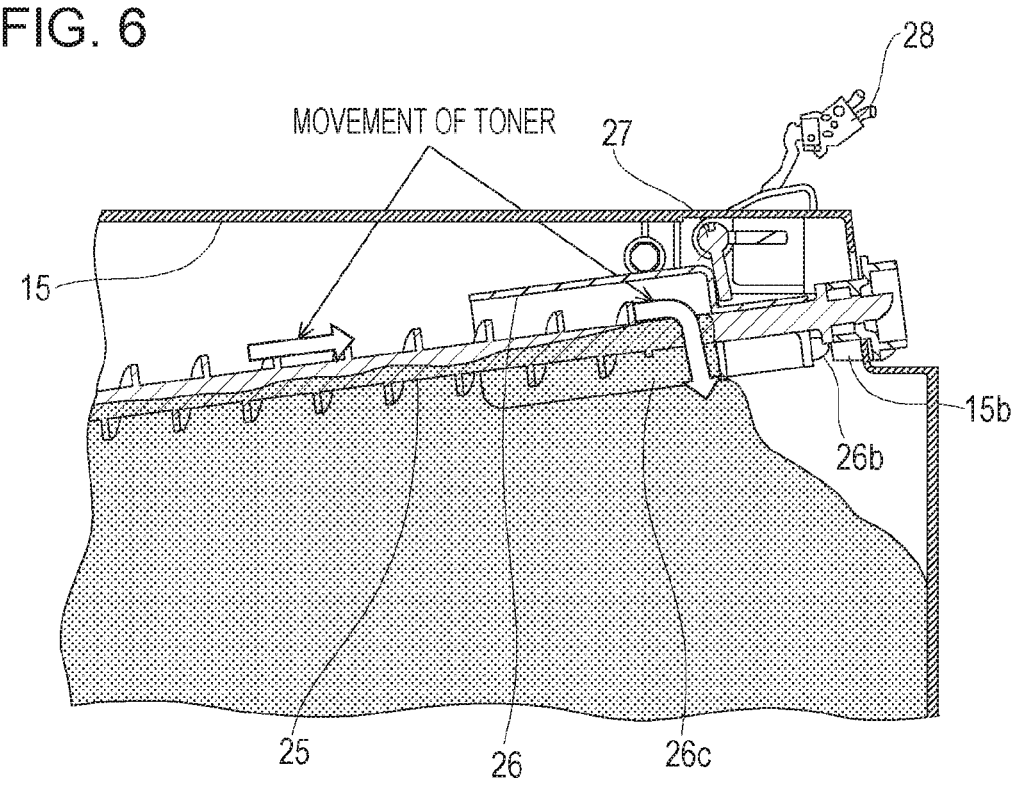
FIG. 6 illustrates the toner collecting case according to the first embodiment of the present invention at the detection of the nearly full state.

Referring to FIGS. 4 to 6, the manner in which toner accumulates in the toner collecting case 15 will now be described in detail. FIGS. 4, 5, and 6 are schematic diagrams illustrating the internal configuration of the toner collecting case 15. FIG. 4 illustrates a state where there is still enough room to receive toner and the nearly full state has yet to be detected, i.e., the toner collecting case 15 has not yet filled up. FIG. 5 illustrates a state of the movable member 26 at the detection of the nearly full state. FIG. 6 illustrates a state after the detection of the nearly full state and more toner has accumulated.

Before the detection of the nearly full state, as illustrated in FIG. 4, toner falls freely and accumulates naturally. When the top of accumulated toner reaches the conveying screw 25, toner starts to be conveyed by the conveying screw 25. As more toner accumulates, the shape of the accumulated toner changes and the movable member 26 starts to be moved. As illustrated in FIG. 5, the movable member 26 is held on the conveying screw 25 and has a substantially box-like shape with the bottom thereof facing toward the upper side and sidewalls thereof provided on the leading side in the direction of toner conveyance and on the right and left sides of the conveying screw 25, so that the force applied to the movable member 26 from the accumulated toner is not released in the foregoing four directions. Hence, the movable member 26 is efficiently movable while being carried by the accumulated toner, and the occurrence of variations in the timing of detection is suppressed.

After the nearly full state is detected and the movable member 26 is moved a predetermined length along the conveying screw 25, referring now to FIG. 6, a movable-member knocking portion 26*b* of the movable member 26 knocks against a toner-collecting-case knocking portion 15*b* (a regulating portion) of the toner collecting case 15, whereby the movement of the movable member 26 is regulated. Thereafter, even if more toner is conveyed by the conveying screw 25, the toner is pushed out of the movable member 26 from an opening 26*c* provided on the lower side of the movable member 26. That is, as described above, the movable member 26 has a substantially box-like shape that is open on the leading side and the trailing side thereof in the direction of toner conveyance and on the lower side thereof. Toner that is moved from the trailing side in the direction of toner conveyance into the movable member 26 having the above box-like shape is guided by the right and left sidewalls and the wall (a guiding portion) on the leading side in the direction of toner conveyance. Then, the toner is pushed out through the opening 26*c*, provided on the lower side, and moves deeper into the collecting area of the toner collecting case 15.

According to the first embodiment, the opening 26*c* is provided on the lower side and is oriented slightly obliquely toward the leading side in the direction of toner conveyance. Therefore, toner is moved smoothly deeper into the collecting area (toward the downstream side in the direction of toner conveyance). Such a configuration suppresses the occurrence of damage to the conveying screw 25 and/or a driving system provided for the conveying screw 25 and a malfunction of a driving-force-transmitting portion due to an excessive rotational load applied to the conveying screw 25. The movable member 26 is provided near the innermost and highest position in the collecting area of the toner collecting case 15, and toner is therefore pushed downward from the movable member 26. Thus, toner can be stored in a more compressed state than in the related art. Hence, the time period given after the detection of the nearly full state and before the apparatus is stopped can be set longer than in the related art. Furthermore, since the packing rate of the toner collecting case 15 is higher than in the related art, the frequency of replacement of the toner collecting case 15 is lower than in the related art.

The opening 26*c* does not necessarily need to be provided on the lower side of the movable member 26 as in the first embodiment. Depending on the shape of the toner collecting case 15, the opening 26*c* can be provided on a lateral side or on the upper side of the movable member 26. Even in such a case, the advantageous effects described above are produced. The configuration of the movable member 26 is not limited to that described in the first embodiment as long as the movable member 26 is configured to urge toner to move deeper into the collecting area so that collected toner is more efficiently packed in the collecting area.

According to the first embodiment featuring a method of identifying the amount of collected toner by using a sensor, the efficiency of packing toner in the toner collecting case is increased without increasing the size of the apparatus, and the time period given after the detection of the nearly full state and before the apparatus is stopped can be set longer than in the related art. Therefore, the user is provided with sufficient time to prepare a new toner collecting case, and the downtime of the apparatus is minimized.

Second Embodiment

Figure 7:
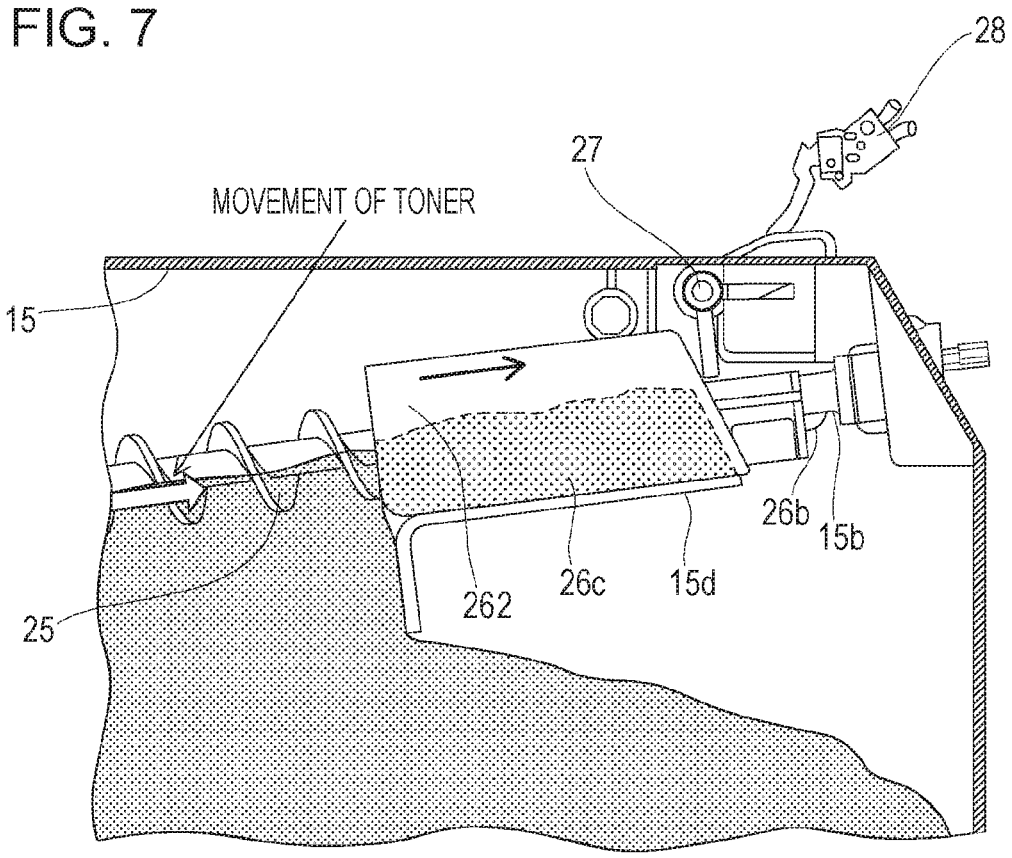
FIG. 7 illustrates a toner collecting case according to a second embodiment of the present invention at the detection of the nearly full state.
Figure 8:
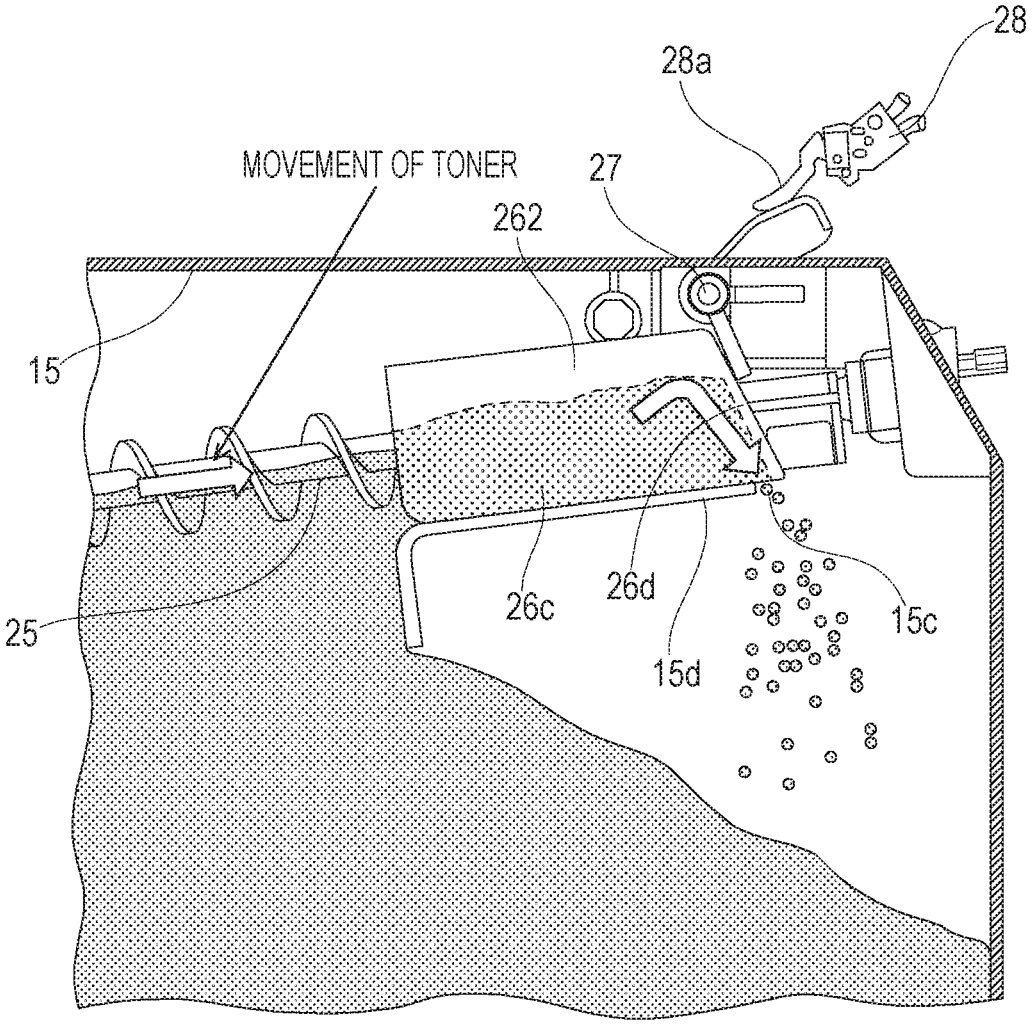
FIG. 8 illustrates the toner collecting case according to the second embodiment of the present invention after the detection of the nearly full state.

Referring to FIGS. 7 and 8, a second embodiment of the present invention will now be described. FIG. 7 is a schematic sectional view of a toner collecting case 15 according to the second embodiment at the detection of the nearly full state. FIG. 8 is a schematic sectional view of the toner collecting case 15 according to the second embodiment after the detection of the nearly full state. The configuration of an image forming apparatus according to the second embodiment, particularly the basic elements such as the toner conveying mechanism, the toner collecting case, and the mechanism of detecting the full state, are the same as those of the first embodiment. Therefore, such elements that are common to the first and second embodiments are denoted by their corresponding reference numerals used in the first embodiment, and redundant description thereof is omitted in the second embodiment. Details not discussed in the second embodiment have already been described in the first embodiment.

As illustrated in FIG. 7, according to the second embodiment, before and when a movable member 262 comes into contact with the detecting lever 27 (immediately before the movable member 262 moves the sensor lever 28*a*), the opening 26*c* provided on the lower side of the movable member 262 is closed by a wall 15*d* (a closing portion) provided on the toner collecting case 15. Immediately after the movable member 262 comes into contact with the detecting lever 27 and as more toner is collected and pushes the movable member 262 further, the opening 26*c* begins to open, whereby an opening 15*c* enabling toner to fall down from the movable member 262 is provided. The opening 15*c* is defined by the opening 26*c* of the movable member 262 and the wall 15*d* of the toner collecting case 15. With such a configuration, before the movable member 262 reaches the position for activating the sensor 28 (that is, before the detecting lever 27 pushes the sensor lever 28*a*), there is substantially no way for the toner conveyed by the conveying screw 25 into the movable member 262 to be released from the movable member 262. That is, toner that carries the movable member 262 is prevented from flowing out of the movable member 262 through the opening 26*c*, and a force of moving the movable member 262 is efficiently applied to the movable member 262 from toner conveyed by the conveying screw 25. Hence, the movable member 262 can be moved efficiently, and the variation in the timing of detection of the nearly full state is minimized.

As illustrated in FIG. 8, after the nearly full state is detected (that is, after the movable member 262 has reached the position for activating the sensor 28) and the opening 15*c* is provided, toner conveyed into the movable member 262 is allowed to be released from the lower side of the movable member 262. Such a configuration suppresses the occurrence of damage to the conveying screw 25 and/or a driving system provided for the conveying screw 25 and a malfunction of a driving-force-transmitting portion due to an excessive rotational load applied to the conveying screw 25.

According to the second embodiment, a surface 26*d* of the movable member 262 on the leading side in the direction of toner conveyance is inclined such that the force applied to toner (in the direction of toner movement) is redirected toward the opening 15*c* (such that toner is guided obliquely downward and toward the leading side in the direction of toner conveyance). Thus, toner smoothly flows out of the movable member 262 downward and is accumulated while being compressed more than in the related art. Consequently, the time period given after the detection of the nearly full state and before the apparatus is stopped can be set longer than in the related art. Furthermore, since the packing rate of the toner collecting case 15 is higher than in the related art, the frequency of replacement of the toner collecting case 15 is lower than in the related art.

Third Embodiment

Figure 9:
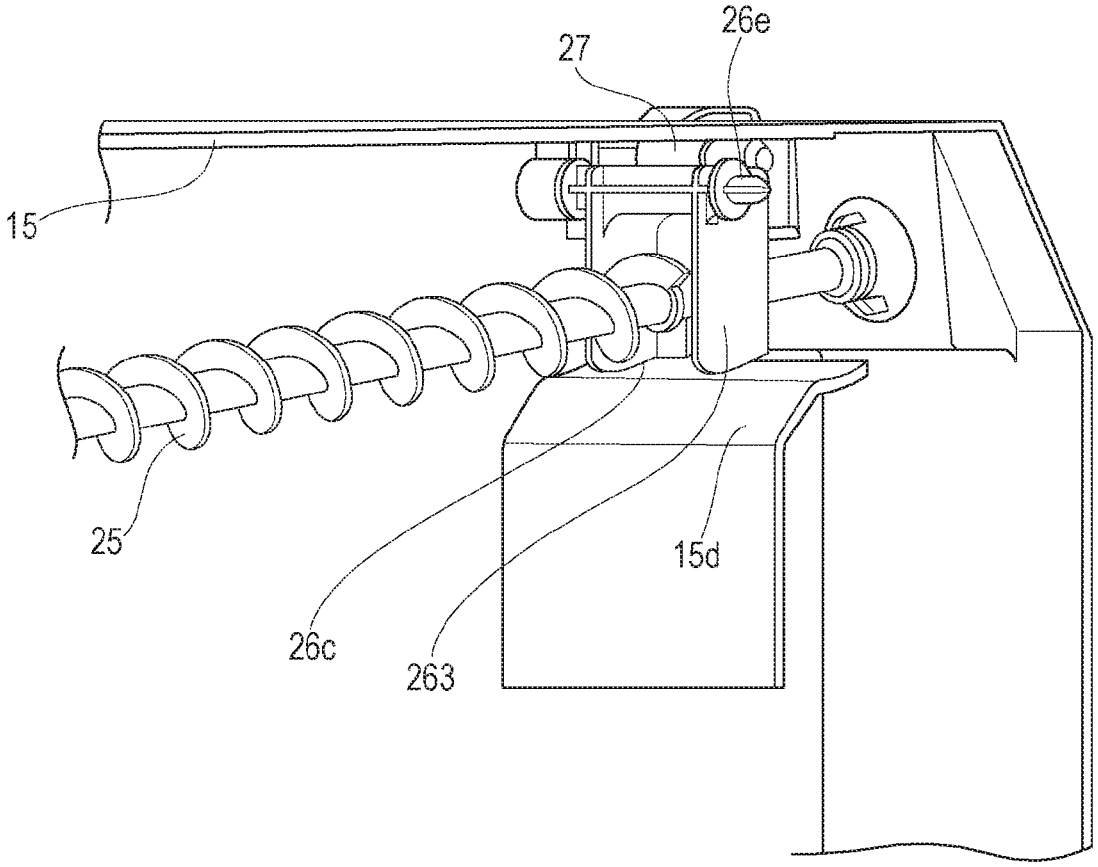
FIG. 9 is an internal perspective view of a toner collecting case according to a third embodiment of the present invention.
Figure 10:
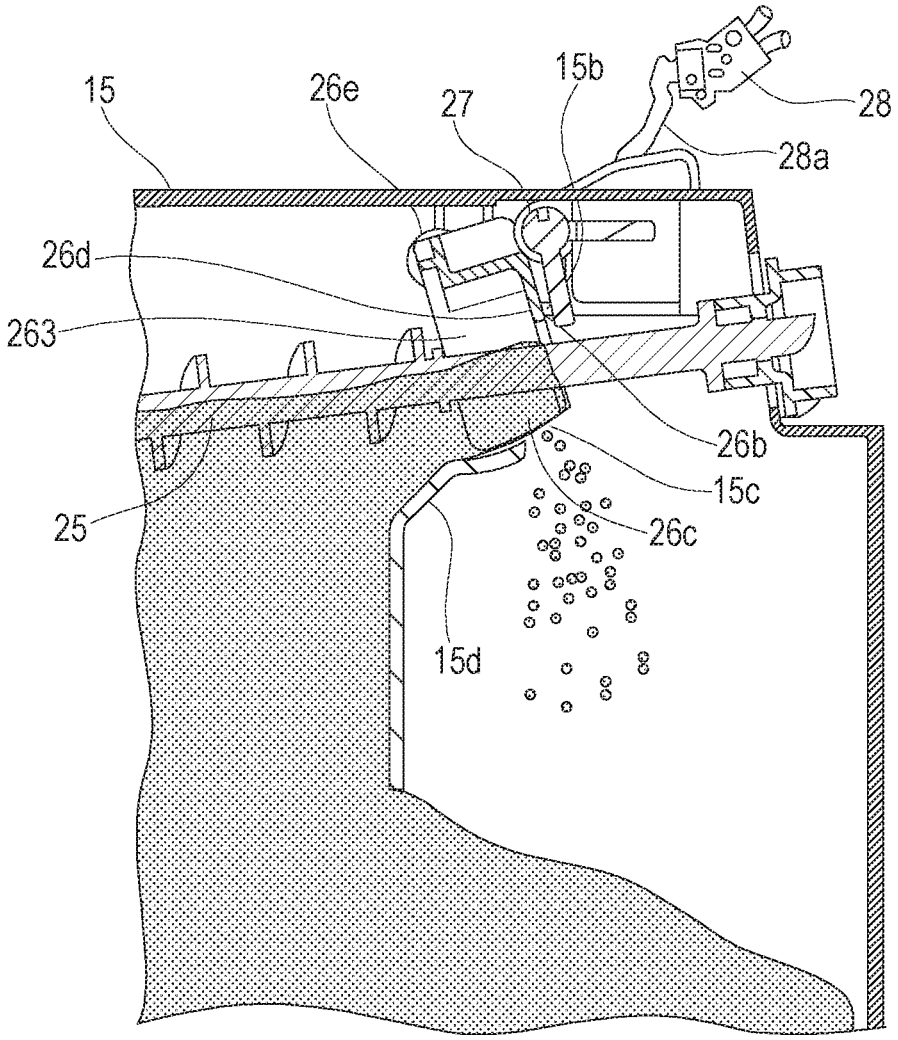
FIG. 10 illustrates the toner collecting case according to the third embodiment of the present invention after the detection of the nearly full state.

Referring to FIGS. 9 and 10, a third embodiment of the present invention will now be described. FIG. 9 is an internal perspective view of a toner collecting case 15 according to the third embodiment of the present invention. FIG. 10 is a schematic sectional view of the toner collecting case 15 according to the third embodiment immediately after the detection of the nearly full state. The configuration of an image forming apparatus according to the third embodiment, particularly the basic elements such as the toner conveying mechanism, the toner collecting case, and the mechanism of detecting the full state, are the same as those of the first or second embodiment. Therefore, such elements that are common to the first to third embodiments are denoted by their corresponding reference numerals used in the first or second embodiment, and redundant description thereof is omitted in the third embodiment. Details not discussed in the third embodiment have already been described in the first or second embodiment.

As illustrated in FIG. 9, according to the third embodiment, a movable member 263 is held (supported) by and is rotatable about a shaft 26*e* provided on the toner collecting case 15. The movable member 263 rotates when pushed by toner conveyed thereto by the conveying screw 25. That is, the movable member 263 according to the third embodiment moves (rotates) such that the angle thereof changes in accordance with the amount of toner accumulated in the toner collecting case 15. The movable member 263 according to the third embodiment also has a substantially box-like shape, as with the movable member 262 according to the second embodiment. Before and when the movable member 263 comes into contact with the detecting lever 27 (immediately before the movable member 263 moves the sensor lever 28*a*), the opening 26*c* provided on the lower side of the movable member 263 is closed by the wall 15*d* provided on the toner collecting case 15. As the movable member 263 is further rotated, the opening 26*c* begins to open, whereby the opening 15*c* enabling toner to fall down from the movable member 263 is provided (see FIG. 10). With such a configuration, before the movable member 263 reaches the position for activating the sensor 28 (that is, before the detecting lever 27 pushes the sensor lever 28*a*), there is substantially no way for the toner conveyed by the conveying screw 25 into the movable member 263 to be released from the movable member 263. Hence, the movable member 263 can be rotated efficiently, and the variation in the timing of detection of the nearly full state is minimized.

After the nearly full state is detected (that is, after the movable member 263 has reached the position for activating the sensor 28), the opening 15*c* enabling toner to flow downward out of the movable member 263 is provided. Such a configuration suppresses the occurrence of damage to the conveying screw 25 and/or a driving system provided for the conveying screw 25 and a malfunction of a driving-force-transmitting portion due to an excessive rotational load applied to the conveying screw 25.

According to the third embodiment, the shaft 26*e* is provided at such a position that, when the movable member 263 is rotated, the surface 26*d* of the movable member 263 on the leading side in the direction of toner conveyance is inclined and the force applied to toner (in the direction of toner movement) is redirected toward the opening 15*c*. That is, the orientation (the phase of rotation) of the movable member 263 is retained with the surface 26*d* of the movable member 263 on the leading side in the direction of toner conveyance (a guiding surface) being inclined in such a manner as to guide toner obliquely downward toward the leading side in the direction of toner conveyance. Thus, toner smoothly flows out of the movable member 263 downward and is accumulated while being compressed more than in the related art. Consequently, the time period given after the detection of the nearly full state and before the apparatus is stopped can be set longer than in the related art. Furthermore, since the packing rate of the toner collecting case 15 is higher than in the related art, the frequency of replacement of the toner collecting case 15 is lower than in the related art.

While aspects of the present invention have been described with reference to exemplary embodiments, it is to be understood that the aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2015-137311, filed Jul. 8, 2015, which is hereby incorporated by reference herein in its entirety.

What is claimed is:

1. A container in which toner discharged from an apparatus body of an image forming apparatus is collected, the container comprising:

an intake portion from which the toner discharged from the apparatus body enters the container;

a collecting portion in which the toner entering via the intake portion accumulates;

a conveying member configured to convey the toner in the collecting portion in a direction away from the intake portion; and a movable member movable in accordance with an amount of toner in the collecting portion and configured to cause, when the movable member is at a first position, a detecting portion to detect an amount of toner in the collecting portion, the detecting portion being provided on the apparatus body, wherein the movable member (i) includes a guiding portion configured to guide the toner in a direction away from the first position while the toner is conveyed by the conveying member and (ii) forms an opening, and wherein the container further comprises a closing portion configured to close the opening after the movable member starts to move and before the movable member reaches the first position, the closing portion opening the opening enabling the toner to be released from the movable member through the opening when the movable member moves further than the first position by further accumulated toner in the collecting portion after the movable member starts to move.

2. The container according to claim 1, wherein the movable member is configured to be carried at a top of the accumulated toner and to move in the collecting portion with a change in a shape of the accumulated toner.

3. The container according to claim 1, further comprising a detecting lever configured to come into contact with the detecting portion when the detecting lever is pushed by the movable member at the first position.

4. The container according to claim 3, wherein the movable member is movable in the direction in which the toner is conveyed by the conveying member, and wherein the detecting lever is provided on a downstream side of the first position in the direction in which the toner is conveyed by the conveying member.

5. The container according to claim 1, wherein the conveying member is a screw extending in the direction in which the toner is conveyed by the conveying member, and wherein the movable member is guided by the screw and moves in accordance with the amount of toner in the collecting portion.

6. The container according to claim 1, wherein the movable member is rotatably supported in the collecting portion and is movable such that an angle of the movable member changes with a change in the amount of toner in the collecting portion.

7. The container according to claim 1, further comprising a regulating portion configured to regulate the movable member from moving toward a downstream side of the first position in the direction in which the toner is conveyed by the conveying member.

8. The container according to claim 1, wherein the container is detachably attached to the apparatus body of the image forming apparatus.

9. A container in which toner discharged from an apparatus body of an image forming apparatus is collected, the container comprising:

an intake portion from which the toner discharged from the apparatus body enters the container;

a collecting portion in which the toner entering via the intake portion accumulates;

a conveying member configured to convey the toner in the collecting portion in a direction away from the intake portion; and a movable member movable in accordance with an amount of toner in the collecting portion and configured to cause, when the movable member is at a first position, a detecting portion to detect an amount of toner in the collecting portion, the detecting portion being provided on the apparatus body, wherein the movable member (i) includes a guiding portion configured to guide the toner in a direction away from the first position while the toner is conveyed by the conveying member and (ii) forms an opening on a lower side, and wherein the container further comprises a closing portion configured to close the opening before the movable member reaches the first position.

10. The container according to claim 9, wherein the closing portion closes the opening in such a manner as to regulate the toner carrying the movable member from being released from the movable member through the opening before the movable member reaches the first position, and wherein, when the movable member reaches the first position, the closing portion opens the opening, enabling the toner to be released from the movable member through the opening.

11. An image forming apparatus comprising:

an apparatus body;

a detecting portion; and a container in which toner discharged from the apparatus body is collected, the container including an intake portion from which the toner discharged from the apparatus body enters the container;

a collecting portion in which the toner entering via the intake portion is accumulated;

a conveying member configured to convey the toner in the collecting portion in a direction away from the intake portion; and a movable member movable in accordance with an amount of toner in the collecting portion and configured to cause, when the movable member is at a first position, a detecting portion to detect an amount of toner in the collecting portion, the detecting portion being provided on the apparatus body, wherein the movable member includes (i) a guiding portion configured to guide the toner in a direction away from the first position while the toner is conveyed by the conveying member and (ii) forms an opening, and wherein the container further comprises a closing portion configured to close the opening after the movable member starts to move and before the movable member reaches the first position, the closing portion opening the opening enabling the toner to be released from the movable member through the opening when the movable member moves further than the first position by further accumulated toner in the collecting portion after the movable member starts to move.

12. The image forming apparatus according to claim 11, wherein the movable member is configured to be carried at a top of the accumulated toner and to move in the collecting portion with a change in a shape of the accumulated toner.

13. The image forming apparatus according to claim 11, wherein the container further includes a detecting lever configured to come into contact with the detecting portion when the detecting lever is pushed by the movable member at the first position.

14. The image forming apparatus according to claim 13, wherein the movable member is movable in the direction in which the toner is conveyed by the conveying member, and wherein the detecting lever is provided on a downstream side of the first position in the direction in which the toner is conveyed by the conveying member.

15. The image forming apparatus according to claim 11, wherein the conveying member is a screw extending in the direction in which the toner is conveyed by the conveying member, and wherein the movable member is guided by the screw and moves in accordance with the amount of toner in the collecting portion.

16. The image forming apparatus according to claim 11, wherein the movable member is rotatably supported in the collecting portion and is movable such that an angle of the movable member changes with a change in the amount of toner in the collecting portion.

17. The image forming apparatus according to claim 11, wherein the container further includes a regulating portion configured to stop the movable member from moving toward a downstream side of the first position in the direction in which the toner is conveyed by the conveying member.

18. The image forming apparatus according to claim 11, wherein the container is detachably attached to the apparatus body of the image forming apparatus.

19. An image forming apparatus comprising:

an apparatus body;

a detecting portion; and a container in which toner discharged from the apparatus body is collected, the container including an intake portion from which the toner discharged from the apparatus body enters the container;

a collecting portion in which the toner entering via the intake portion is accumulated;

a conveying member configured to convey the toner in the collecting portion in a direction away from the intake portion; and a movable member movable in accordance with an amount of toner in the collecting portion and configured to cause, when the movable member is at a first position, the detecting portion to detect an amount of toner in the collecting portion, the detecting portion being provided on the apparatus body, wherein the movable member (i) includes a guiding portion configured to guide the toner in a direction away from the first position while the toner is conveyed by the conveying member and (ii) forms an opening on a lower side, and wherein the container further includes a closing portion configured to close the opening before the movable member reaches the first position.

20. The image forming apparatus according to claim 19, wherein the closing portion closes the opening in such a manner as to regulate the toner carrying the movable member from being released from the movable member through the opening before the movable member reaches the first position, and wherein, when the movable member reaches the first position, the closing portion opens the opening, enabling the toner to be released from the movable member through the opening.

* * * * *